US006676000B2

(12) United States Patent
Lang et al.

(10) Patent No.: US 6,676,000 B2
(45) Date of Patent: Jan. 13, 2004

(54) DRIVE SYSTEM FOR A FASTENING TOOL

(75) Inventors: Hans Jörg Lang, Werther (DE); Wermer Helmig, Biberach (DE)

(73) Assignee: Bollhoff GmbH, Bielefeld (DE)

( * ) Notice: Subject to any disclaimer, the term of this patent is extended or adjusted under 35 U.S.C. 154(b) by 98 days.

(21) Appl. No.: 10/101,134

(22) Filed: Mar. 19, 2002

(65) Prior Publication Data

US 2002/0144386 A1 Oct. 10, 2002

(30) Foreign Application Priority Data

Apr. 9, 2001 (DE) ..... 201 06 207 U

(51) Int. Cl.[7] ..... B21J 15/28
(52) U.S. Cl. ..... 227/51; 227/58; 227/152
(58) Field of Search ..... 227/51, 2, 68, 227/58, 152, 53; 29/243.54, 243.53, 243.525; 72/391.2, 391.4

(56) References Cited

U.S. PATENT DOCUMENTS 4,259,858 A * 4/1981 Freeman et al. ..... 227/51
4,515,302 A * 5/1985 Davern et al. ..... 227/58
5,156,313 A * 10/1992 Smart et al. ..... 227/51
5,199,624 A * 4/1993 Smart et al. ..... 227/51
5,323,946 A * 6/1994 O'Connor et al. ..... 29/243.525

FOREIGN PATENT DOCUMENTS

| | | |
|---|---|---|
| DE | 420103 | 10/1925 |
| DE | 198 08 016 | 3/1999 |
| GB | 1 528 431 | 10/1978 |

* cited by examiner

*Primary Examiner*—Scott A. Smith
(74) *Attorney, Agent, or Firm*—Seyfarth Shaw LLP

(57) ABSTRACT

A drive system for a fastening tool, in particular a riveting tool, includes a punch for a fastening operation and a clamp axially moveable relative to the punch for clamping the workpieces during the fastening operation. The punch is actuated by a drive so as to be displaced axially. During such operation the drive force exerted upon the punch is transmitted to the clamp by force transmitting means comprising an air pressure chamber of variable volume.

13 Claims, 2 Drawing Sheets

DRIVE SYSTEM FOR A FASTENING TOOL

BACKGROUND OF THE INVENTION

The present invention relates to a drive system for a fastening tool for fastening one or a plurality of workpieces of ductile material, the fastening tool comprising a punch for performing a fastening operation and a clamp axially displaceable relative to said punch and providing a clamping force for clamping said one or said plurality of workpieces during said fastening operation.

Known fastening tools such as tools for setting self-piercing rivets generally use hydraulic drive systems. In such drive systems the force for actuating the punch (the fastening force) is generated by means of a hydraulic cylinder which transmits hydraulic pressure directly or indirectly to the punch, see for example DE 199 24 310.

The clamping force exerted by the clamp upon the workpieces may be generated either by an additional hydraulic cylinder or by the punch via force transmitting means comprising a spring. While these drive systems have been successful in practice, they are not equally well suited for all types of applications. The use of an additional hydraulic cylinder requires substantial structure and complicated control systems. The use of a spring as force transmitting means involves the risk of spring failure resulting in reduced reliability of the fastening tool. Furthermore, the clamping force is fixed by the spring and cannot be varied.

SUMMARY OF THE INVENTION

It is an object of the present invention to provide a drive system for a fastening tool which avoids the disadvantages of prior drive systems.

It is a further object of the invention to provide a drive system for a fastening tool which is of simple structure, improved reliability and reduced wear.

It is still another object of the invention to provide a drive system for a fastening tool wherein the clamping force for clamping the workpieces can be varied and individually set.

In accordance with the present invention the force transmitting means between the punch and the clamp comprises an air pressure chamber of variable volume which can be reduced by axial relative movements between the punch and the clamp during the fastening operation in order to compress pressure air therein so as to increase the clamping force. As a result the air pressure chamber acts as a pneumatic spring which generates a predetermined clamping force.

Since the drive system of the present invention does not require a mechanical spring for transmitting forces between the punch and the clamp, the drive system is extremely reliable, exhibits reduced wear and is of increased duration. Furthermore, the invention enables continuously to set the initial pressure within the air pressure chamber to any desired value. As a result the clamping force can be set individually and rapidly and furthermore can be adapted to specific applications. Furthermore, the pressure within the air pressure chamber can be selectively controlled by a variable restriction or pressure control means.

The drive may be a conventional actuator such as a hydraulic cylinder which acts upon the punch either directly or indirectly. However, it is preferred that the drive comprises an electric motor and a spindle mechanism driven by the electric motor.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
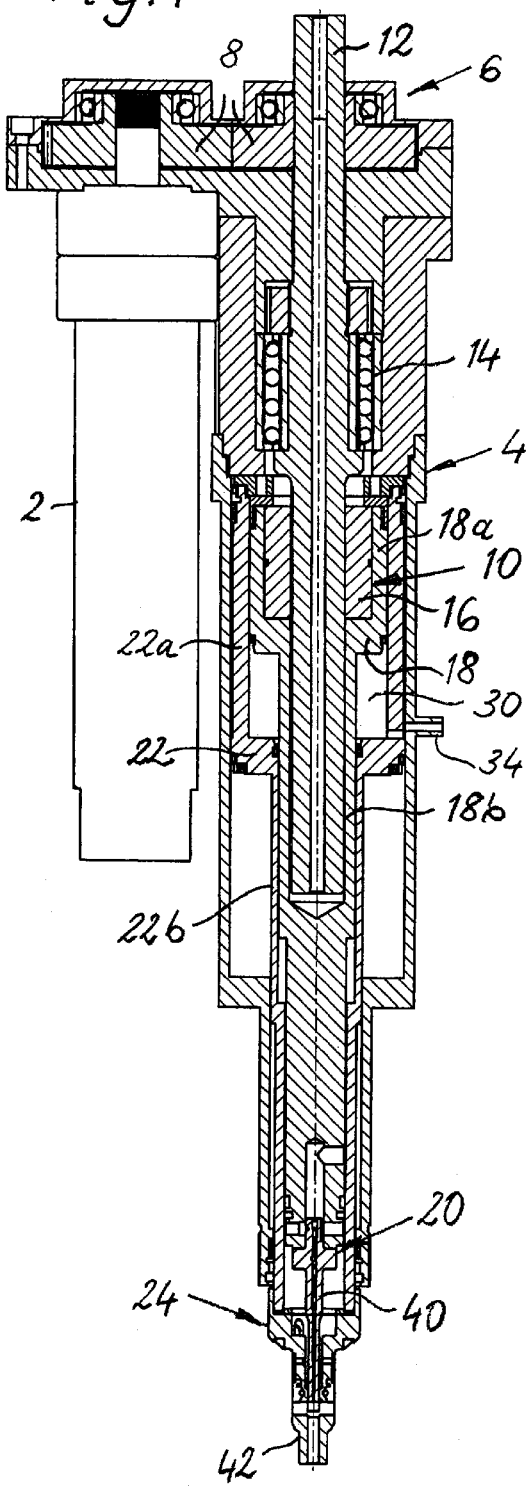
FIG. 1 is a longitudinal sectional view of a rivet setting tool when in its neutral position.
Figure 2:
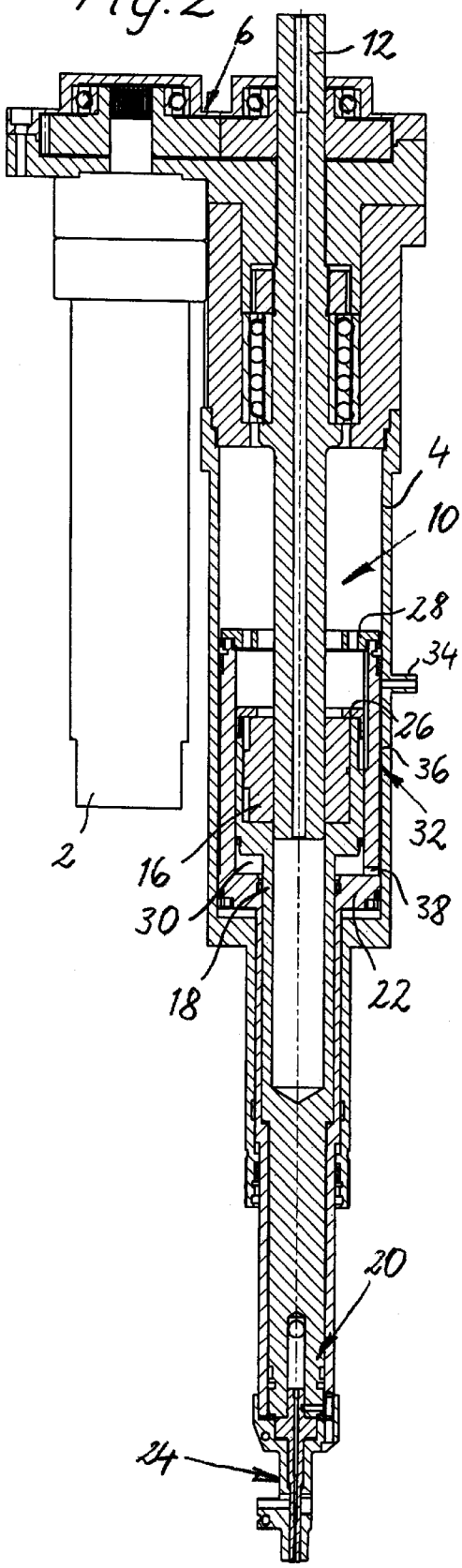
FIG. 2 is a longitudinal sectional view of the rivet setting tool in FIG. 1 when in its operative position.

Referring to FIGS. 1 and 2, the fastening tool shown therein is a rivet setting tool for setting self-piercing rivets. It is to be understood that the invention can be used also in connection with other fastening tools such as clinching tools.

The drive system of the rivet setting tool as shown includes an electric motor 2 which is mounted to the outside of a tubular housing 4 of the rivet setting tool proper. The electric motor 2 is operatively connected to a spindle mechanism 10 by a speed reducing gear mechanism 6 comprising a pair of planetary gears 8. The spindle mechanism 10 is disposed within the housing 4 which is made up of a plurality of housing members. The pair of planetary gears 8 which intermesh with each other are rotatably mounted by means of ball bearings in associated housing portions as schematically shown; the one planetary gear 8 is fixed to an outlet shaft of the electric motor 2, and the other planetary gear 8 is fixed to a spindle 12 of the spindle mechanism 10. The gear mechanism 6 is intended to increase the torque transmitted from the electric motor 2 to the spindle mechanism 10 by a predetermined factor and to reduce the drive speed by the same factor.

The spindle 12 of the spindle mechanism 10 which is disposed within the housing 4 so as to be concentric thereto is mounted within the housing 4 by a ball bearing 14 so as to be rotatable and axially fixed. The spindle 12 is in engagement with a nut 16. The nut 16 is fixed to a punch member 18 of a punch 20 for setting the self-piercing rivets (not shown). The nut 16 and the punch 20 along with the punch member 18 are guided so as to be non-rotatable and axially displaceable relative to the housing 4. Therefore, rotational movements of the spindle 12 will cause axial movements of the nut 16 and the punch 20.

The punch 20 along with the punch member 18 is coaxially surrounded by a clamp member 22 of a clamp 24. The clamp 24 along with the clamp member 22 is mounted so as to be axially displaceable relative to the punch 20 and relative to the housing 4 in order to exert a clamping force upon the sheets to be riveted (not shown) during a riveting operation as will be explained in more detail thereafter.

As shown in FIGS. 1 and 2, the punch member 18 is provided at its top with a cover 26 which retains the nut 16 within the punch member 18. The clamp member 22 is provided at its top also with a cover 28 which engages the bottom of a housing member 4*a* when the rivet setting tool is in its neutral position (FIG. 1).

The punch member 18 and the clamp member 22 each have a pair of cylindrical portions 18*a*, 18*b*, and, respectively, 22*a*, 22*b* which are disposed within each other and sealingly engage each other such that opposed circumferential and shoulder surfaces of these portions define an air pressure chamber 30 therebetween. As indicated in FIGS. 1 and 2, the portions 18*a* and 22*a* and, respectively, 18*b* and 22*b* are sealed from each other by sealing means so that the air pressure chamber 30 insofar is a fluid tight chamber.

However, the air pressure chamber 30 of the embodiment as shown communicates with a (not shown) air pressure source via a flow passage 32. The flow passage 32 comprises an air pressure port 34 provided on the outside of the housing 4, an annular space 36 between the housing 4 and the clamp member 22 extending for the total length of the portion 22*a*, and a through flow orifice 38 provided in the clamp member 22 so as to provide for fluid communication between the annular space 36 and the air pressure chamber 30.

A fastening member 40 of the punch 20 and a nose piece 42 of the clamp 24 are of conventional construction and may be designed as in DE 199 24 310 the contents of which are incorporated herein by reference.

The operation of the rivet setting tool as described is as follows. On the outset the rivet setting tool is in its neutral position shown in FIG. 1. When the electric motor 2 will be operated, the electric motor will rotate the spindle 12 of the spindle mechanism 10 via the gear mechanism 6. As a result thereof the nut 16 and the punch member 18 fixed thereto will be moved axially downwards. They will take along the clamp 24 with the clamp member 22 via the air pressure chamber 30 acting as a pneumatic spring.

When the nosepiece 42 of the clamp 24 engages the upper surface of the sheets to be riveted (not shown), the clamp 24 will be stationary. The punch 20 along with the punch member 18, however, will be advanced further by the spindle mechanism 10 until the fastening member 40 of the punch 20 along with an upsetting die (not shown) has set the rivet in the sheets; this is the position shown in FIG. 2.

During this operation the volume of the air pressure chamber 30 will be reduced so that pressure air within the air pressure chamber 30 will be compressed and its pressure increased accordingly. This will result in a corresponding increase of the clamping force which the clamp 24 exerts upon the sheets. In the embodiment as shown the ratio of volume reduction of the air pressure chamber is in the order of 3. The flow passage 32 allows to set the initial pressure within the air pressure chamber 30 to a predetermined value. This allows to select any value of the clamping force by means of the air pressure chamber 30 so that the clamping force may be readily and individually adapted to any specific application.

If for example the pressure within the air pressure chamber 30 as initially set is in the order of 6 bar and the volume reduction ratio of the air pressure chamber 30 is in the order of 3, the maximal clamping force that can be obtained in the embodiment as shown will be in the order of 4 kN. When the pressure within the air pressure chamber 30 is initially set to a lower value, correspondingly lower values of the clamping force at the beginning and end of the riveting operation will result.

In order to prevent backflow of the increased pressure within the air pressure chamber 30 to the air pressure source via the flow passage 32, a releasable check valve (not shown) will be provided to prevent escape of pressure from the air pressure chamber 30. Furthermore, the flow passage 32 may include a variable restriction (not shown) for arbitrarily controlling the pressure within the air pressure chamber 30. This allows to vary the clamping force even during the riveting operation in any desired manner.

As may be readily appreciated the air pressure chamber 30 which acts as a pneumatic spring allows to readily and continuously set the clamping force while wear of the structural members involved therewith is minimal.

In order to return the rivet setting tool from its operative position shown in FIG. 2 to its neutral position shown in FIG. 1, the reversible electric motor 2 will be rotated in the reverse direction. As a result thereof the spindle mechanism 10 will move the nut 16 and the punch 20 upwards. When the cover 26 of the punch member 18 engages the cover 28 of the clamp member 22, the punch 22 will move the clamp 24 upwards until the punch 20 and the clamp 24 will have reached again their upper end position (neutral position of FIG. 1). The rivet setting tool is then ready for the next riveting operation.

Figure 3:
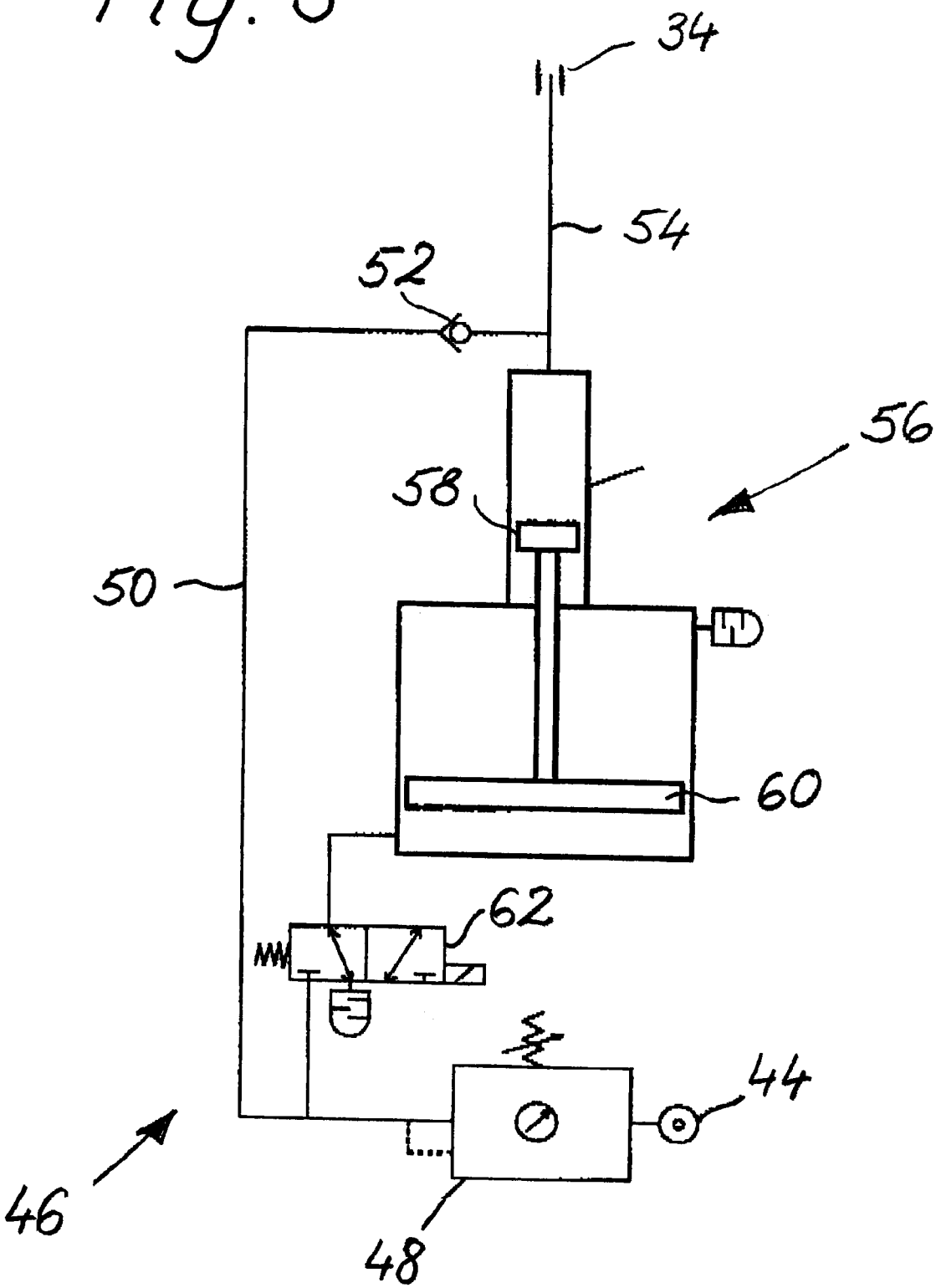
FIG. 3 is a schematic view of a pressure control device for the rivet setting tool.

FIG. 3 is a schematic diagram of a pressure control system 46 for controlling the pressure in the air pressure chamber 30.

The pressure control system 46 includes a pressure regulator 48 which has an inlet communicating with an air pressure source 44 and an outlet communicating with the air pressure port 34 of the air pressure chamber 30 via a conduit 50, a check valve 52 and a conduit 54. The pressure control system 46 furthermore includes a pressure transducer 46 comprising a stepped air pressure cylinder having a stepped piston assembly comprising a piston 58 of reduced cross section and a piston 60 of increased cross section. The pressure transducer 56 has one side of the piston 58 of reduced cross section communicate with the air pressure port 34 via a conduit 54, while it communicates on the other side of the piston 60 of increased cross section with the pressure regulator 48 via a valve 62. The pressure transducer 56 has its area between pistons 56 and 60 communicate with the atmosphere via a (schematically shown) filter.

The operation of the pressure control system is as follows. At the beginning of a rivet setting operation the air pressure chamber 30 is pressurized by the air pressure source 44 via the pressure regulator 48 and the conduits 50, 54 so as to exhibit a predetermined initial pressure. The pressure transducer 46 is now used to vary the pressure in a desired manner during compression of the air within the air pressure chamber 30.

For example pressurization of the pressure transducer 56 can be controlled by means of the valve 62 such that the piston assembly 58, 60 will be in its upper position (in FIG. 3) at the beginning of a rivet setting operation. When the air within the air pressure chamber 30 will be compressed for performing a rivet setting operation, the piston 58 of reduced cross section will be pressurized by the pressure air displaced from the air pressure chamber 30 via the conduit 54 such that the piston assembly 58, 60 will move downwards. Depending on the ratio of the pressurized surfaces of the pistons 56 and 60 a relatively slight pressure increase or even a constant pressure in the air pressure chamber 30 may be obtained.

If, however, pressurization of the pressure transducer 56 will be controlled at the beginning of a rivet setting operation such that the piston assembly 58, 60 initially will remain in its lower position (in FIG. 3) and thereafter will be moved upwards when the volume of the air pressure chamber 30 will be reduced, a correspondingly steep increase of the pressure within the air pressure chamber will result. Generally, the pressure control system 46 allows to control the pressure within the air pressure chamber 30 in any desired manner when the pressure transducer 56 communicates via valve 62 with a separate pressure regulator providing for pressure control independently of the pressure fed into the air pressure chamber 30.

We claim:

1. A drive system for a fastening tool for fastening one or a plurality of workpieces of ductile material, the fastening tool comprising a punch for performing a fastening operation and a clamp axially displaceable relative to said punch and providing a clamping force for clamping said one or said plurality of workpieces during said fastening operation, the drive system comprising:

a drive, a punch member adapted to be axially displaced by said drive for actuating said punch, and a clamp member adapted to be axially displaced by said punch member via force transmitting means for actuating said clamp, said force transmitting means comprising an air pressure chamber of variable volume between said clamp member and said punch member, the volume of said air pressure chamber being adapted to be reduced by axial relative movements between said punch and said clamp during said fastening operation in order to compress pressure air within said air pressure chamber so as to increase the clamping force provided by said clamp.

2. The drive system of claim 1 wherein said air pressure chamber is adapted to communicate with an air pressure source via a fluid flow passage for setting a predetermined initial pressure in said air pressure chamber.

3. The drive system of claim 2 wherein said fluid flow passage comprises an air pressure port provided at a housing of said fastening tool, an annular space between said clamp member and said housing, and a through flow orifice in said clamp member to provide communication between said annular space and said air pressure chamber.

4. The drive system of claim 2 wherein said fluid flow passage includes a releasable check valve for preventing pressure air to escape from said air pressure chamber.

5. The drive system of claim 2 wherein said fluid flow passage includes a variable restriction for controlling pressure of the pressure air within said air pressure chamber.

6. The drive system of claim 1 wherein said air pressure chamber communicates with an air pressure source via pressure control means for selectively controlling pressure in said air pressure chamber during said fastening operation.

7. The drive system of claim 6 wherein said pressure control means includes a pressure transducer communicating with said air pressure chamber and a pressure regulator communicating with said air pressure source, said pressure transducer and pressure regulator communicating with each other via valve means.

8. The drive system of claim 1 wherein said punch member and said clamp member each comprise tubular portions of different diameters which are coaxially arranged such that said air pressure chamber is limited by opposite circumferential and shoulder surfaces of said tubular portions.

9. The drive system of claim 1 wherein said drive comprises an electric motor and a spindle mechanism driven by said electric motor and disposed in a housing.

10. The drive system of claim 9 wherein a spindle of said spindle mechanism is mounted so as to be rotatable and axially fixed relative to said housing, and wherein a nut of said spindle mechanism along with said punch member is mounted so as to be non-rotatable and axially displaceable relative to said housing.

11. The drive system of claim 9 wherein said electric motor is reversible.

12. The drive system of claim 9 wherein said electric motor is connected to said spindle mechanism via a speed reduction gear mechanism.

13. The drive system of claim 12 wherein said housing is of tubular shape, said electric motor is disposed outside of said housing, and said speed reduction gear mechanism comprises a planetary gear mechanism including a pair of planetary gears.

* * * * *